US010287666B2

(12) United States Patent
Ebenbeck et al.

(10) Patent No.: US 10,287,666 B2
(45) Date of Patent: May 14, 2019

(54) INSTALLATION AND METHOD FOR THE METALLIC COATING OF A WORKPIECE

(71) Applicant: Sturm Maschinen- & Anlagenbau GmbH, Salching (DE)

(72) Inventors: Andreas Ebenbeck, Straubing (DE); Gerhard Aufschläger, Plattling (DE); Marc Kesting, Straubing (DE); Ralf Völlinger, Straubing (DE)

(73) Assignee: STURM MASCHINEN- & ANLAGENBAU GMBH, Salching (DE)

( * ) Notice: Subject to any disclaimer, the term of this patent is extended or adjusted under 35 U.S.C. 154(b) by 0 days.

(21) Appl. No.: 15/543,831

(22) PCT Filed: Jan. 15, 2016

(86) PCT No.: PCT/EP2016/050745
§ 371 (c)(1),
(2) Date: Jul. 14, 2017

(87) PCT Pub. No.: WO2016/116364
PCT Pub. Date: Jul. 28, 2016

(65) Prior Publication Data

US 2017/0349991 A1 Dec. 7, 2017

(30) Foreign Application Priority Data

Jan. 20, 2015 (EP) ..... 15151718

(51) Int. Cl.
*B05B 7/22* (2006.01)
*C23C 4/134* (2016.01)
(Continued)

(52) U.S. Cl.
CPC ..... *C23C 4/08* (2013.01); *B05B 12/084* (2013.01); *C23C 4/134* (2016.01); *C23C 4/16* (2013.01);
(Continued)

(58) Field of Classification Search
None
See application file for complete search history.

(56) References Cited

U.S. PATENT DOCUMENTS 4,358,471 A * 11/1982 Derkacs ..... C23C 4/129 118/712
4,872,269 A * 10/1989 Sattmann ..... G01B 7/13 33/542
(Continued)

FOREIGN PATENT DOCUMENTS

DE 19934991 A1 6/2000
DE 19910665 A1 7/2000
(Continued)

OTHER PUBLICATIONS

Nadeau et al, "A New Approach to Online Thickness Measurement of Thermal Spray Coatings," Journal of Thermal Spray Technology, 15(4):744-749, Dec. 2006.
(Continued)

*Primary Examiner* — Binu Thomas
(74) *Attorney, Agent, or Firm* — Dinsmore & Shohl LLP

(57) ABSTRACT

The invention relates to an installation and a method for the metallic coating of a workpiece using a coating device, said coating device comprising a displaceable coating lance, by which a metal plasma jet can be generated to create a coating of metal particles. According to the invention, it is provided that the coating device with the coating lance and a measuring device for measuring the coating thickness are jointly integrated in the installation, and that the coating device with
(Continued)

Figures 1, 2, 3:
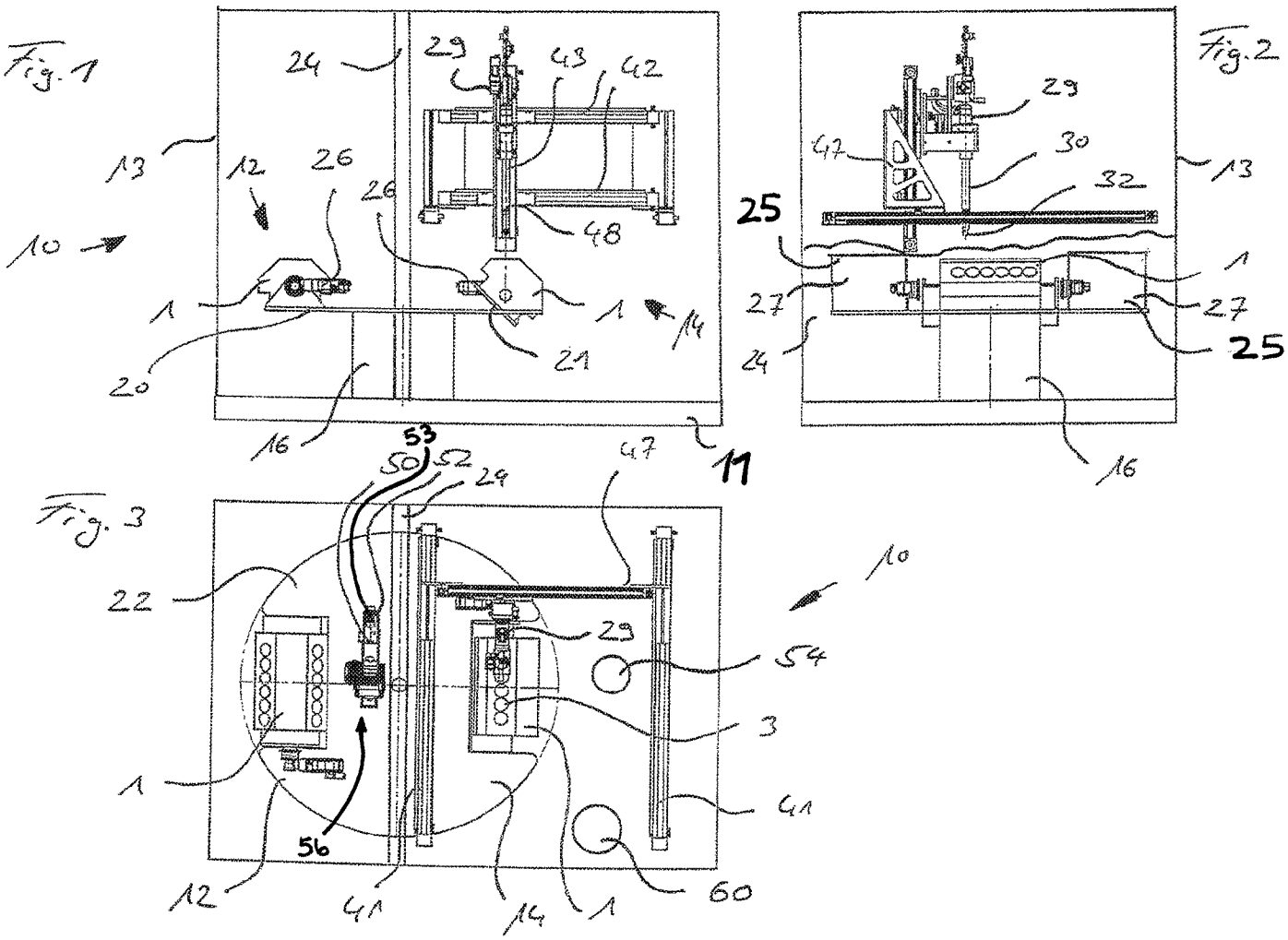

the coating lance as well as the measuring device are enclosed by a housing.

7 Claims, 2 Drawing Sheets

(51) Int. Cl.

| | |
|---|---|
| ***B05B 15/68*** | (2018.01) |
| ***B05B 13/04*** | (2006.01) |
| ***B05B 12/08*** | (2006.01) |
| ***C23C 4/08*** | (2016.01) |
| ***C23C 4/16*** | (2016.01) |
| *B05B 13/06* | (2006.01) |
| *B05B 13/02* | (2006.01) |

(52) U.S. Cl.
CPC ..... *B05B 7/222* (2013.01); *B05B 13/0242* (2013.01); *B05B 13/0431* (2013.01); *B05B 13/06* (2013.01); *B05B 13/0636* (2013.01); *B05B 15/68* (2018.02)

(56) References Cited

U.S. PATENT DOCUMENTS

| | | | | |
|---|---|---|---|---|
| 5,229,840 | A * | 7/1993 | Arnarson | G06T 7/62 356/627 |
| 6,619,645 | B1 * | 9/2003 | Rottler | B23Q 1/52 269/289 R |
| 6,703,579 | B1 * | 3/2004 | Rice | C23C 4/12 219/121.47 |
| 2001/0054654 | A1 * | 12/2001 | Miyai | C23C 4/16 239/225.1 |
| 2003/0019376 | A1 * | 1/2003 | Gary, IV | B41G 7/00 101/226 |
| 2005/0081790 | A1 | 4/2005 | Konishi et al. | |
| 2005/0170099 | A1 * | 8/2005 | Gadow | C23C 4/12 427/446 |
| 2006/0177566 | A1 * | 8/2006 | Price | C23C 4/12 118/712 |
| 2007/0130746 | A1 * | 6/2007 | Sugiyama | B05B 13/0285 118/300 |
| 2007/0251814 | A1 * | 11/2007 | Beele | C23C 14/3407 204/192.1 |
| 2011/0023777 | A1 * | 2/2011 | Nishimura | C23C 4/02 118/663 |
| 2013/0000550 | A1 * | 1/2013 | Brown | C23C 4/00 118/301 |
| 2014/0004255 | A1 | 1/2014 | Whitbeck et al. | |
| 2015/0252464 | A1 * | 9/2015 | Hazel | C23C 4/134 118/302 |
| 2016/0115578 | A1 * | 4/2016 | David | C23C 4/131 118/73 |

FOREIGN PATENT DOCUMENTS

| | | | |
|---|---|---|---|
| DE | 102012109203 | B3 | 11/2013 |
| WO | 2004005575 | A2 | 1/2004 |

OTHER PUBLICATIONS

"An Introduction to Thermal Spray," Issue 5, Oct. 2014.

International Search Report with English translation and Written Opinion dated Jul. 28, 2016 for PCT/EP2016/050745 filed Jan. 15, 2016.

"Thermal Spray Turnkey Coating Systems", Nov. 4, 2014 (Nov. 4, 2014), XP055176279, Retrieved from the Internet: URL:http://www.oerlikon.com/ecomaXL/files/metco/oerlikon_Flyer_Turnkey_Systems_EN1.pdf&download=1 [retrieved on Mar. 13, 2015] the whole document.

"Atmospheric Plasma Spray Solutions", Issue 5—Oct. 2014, Oct. 1, 2014 (Oct. 1, 2014), XP055175949, Retrieved from the Internet: URL:http://www.oerlikon.com/ecomaXL/files/metco/oerlikon_Plasma_Solutions_EN5. pdf&download=1 [retrieved on Mar. 12, 2015] the whole document.

* cited by examiner

INSTALLATION AND METHOD FOR THE METALLIC COATING OF A WORKPIECE

According to the generic term of claim 1, the invention relates to an installation for the metallic coating of a workpiece with a coating device, which comprises a displaceable coating lance, by which a metal plasma jet can be generated to create a coating of metal particles.

According to the generic term of claim 14, the invention also relates to a method for the metallic coating of a workpiece with a displaceable coating lance, by which a metal plasma jet can be generated, by means of which a coating of metal particles is created on the workpiece.

In particular in engine manufacturing it is necessary to provide the treads of cylinder bores with a special metallic coating in order to ensure sufficient friction and lubricating conditions between the cylinder tread and a cylinder piston. This applies particularly if both the housing of the engine and the cylinder piston are made of the same metal, such as aluminum.

From the generic specification DE 199 34 991 A1 or from WO 2004/005575 A2 it is known that a metal coating is applied on a bore wall by means of a coating lance, by which a metal plasma jet is generated. In such a manner, very thin-walled and very stable metal coatings can be created along bore walls.

In this process the coating lance is introduced in a cylinder bore of an engine mount, whereby the generated metal plasma jet is directed at the bore wall. Due to a certain dispersion of the metal plasma jet not all metal particles reach the bore wall. These metal particles that miss the target are referred to as overspray and might lead to undesired faulty coatings in the engine mount or at the coating device.

DE 199 34 991 A1 discloses a device for the metallic coating of a workpiece, in which various processing units are arranged linearly alongside a belt conveyor. As a final processing unit the unit for coating the workpiece is provided. Thereafter, the workpiece is directly removed from the device.

The information brochure of oerlikon metco (issue 5—October 2014) dealing with the topic "Atmospheric Plasma Spray Solutions" discloses a system for coating cylinder housings in accordance with the atmospheric plasma spray process. For this purpose, a plasma lance is attached at a robot arm. A processing unit for processing cylinder housings is provided here, which is surrounded by a casing. For the real-time monitoring of the plasma spray a series of parameters can be monitored during the coating process.

The object of the present invention is to specify an installation and a method for the metallic coating of a workpiece which enable a particularly efficient and accurate application of the coating.

According to the invention, this object is solved on the one hand by an installation comprising the features of claim 1, and on the other hand by a method comprising the features of claim 14. The preferred embodiments of the invention are specified in the dependent claims.

The installation according to the invention is characterized in that the coating device with the coating lance and a measuring device for measuring the coating thickness are jointly integrated in the installation, and that the coating device with the coating lance as well as the measuring device are enclosed by a housing.

A basic idea of the invention is to bringing closely together the processes of coating and measuring the applied coating, so that in total direct and thus more accurate statements regarding the accomplished coating can be made. This is achieved in that the coating device and the measuring device are arranged in the same installation and in particular on the same machine bed, and that they are enclosed by a joint housing. The measured data of the measuring device particularly regarding the coating thickness and the contour of the applied coating allow very precise conclusions regarding the coating process. This can be promptly used in controlling the coating device for coating a subsequent workpiece in order to prevent possible faulty coatings.

The invention thus takes a different approach than previously known installations, in which the measuring device was clearly spaced apart from the coating device because of the risk of undesired accumulations caused by the metal overspray, and was arranged separately from the coating device. It is one finding of the invention that with the downsizing of a necessary procedural step of the coated workpiece from the coating device to the measuring device, the positioning and thus the measuring inaccuracy is increased.

A preferred further development of the invention foresees that the housing comprises a loading station for supplying and discharging the workpiece, that the measuring device is arranged in the loading station, and that the measuring device is additionally designed for measuring the workpiece before coating. With this arrangement variant, the workpiece thus passes through the loading station of the installation twice, namely when supplying and discharging the workpiece. The arrangement of the measuring device in the loading station thus causes that the measuring device can fulfil a double function, namely measuring the workpiece before coating and thereafter measuring the workpiece when it is coated. Particularly when coating bores in a workpiece, such measuring can be accomplished with particularly high accuracy by recording the bore contour by means of the measuring device. In fact, the measuring device measures the surface of the uncoated bore and thereafter the surface contour of the coated bore. By comparing the measuring results accordingly, a particularly accurate measuring of the layer thickness and of the layer thickness curve can be determined.

According to another design variant of the invention it is advantageous, if the measuring device comprises a displaceable measuring sensor, which is displaceable between a calibration station and a workpiece holder in the loading station. The measuring device can particularly comprise an optical measuring sensor, which preferably works together with a laser device. These principally known measuring devices allow a precise recording of a surface contour. By way of a corresponding alignment and calibration of the measuring device, it is possible to measure a diameter of a bore and particularly also the diameter course throughout the axial length of the bore at the same time.

Preferably, the workpiece rests on a workpiece holder from the time it is supplied to the installation until it is discharged again, particularly on a workpiece mount or a workpiece pallet, so that a positioning of the workpiece with high repeatability in the repeated measurements is made possible.

Another advantageous embodiment of the invention foresees that the coating device is arranged in a processing unit that is separated from the loading station, and that a cleaning station for cleaning the coating lance is arranged in the processing station. By separating the processing station in which the coating process with the metal plasma jet is taking place and the loading station in which the measuring is taking place, particularly by means of a partition wall, the coating and the measuring processes can be carried out in close proximity, but without undesired interactions. A further improvement of the accuracy of applying the coating is achieved according to a variant according to the invention in that a cleaning station is provided in the processing station, with which the coating lance is cleaned from accumulated metal particles at specific points in time. These undesired accumulations are caused by the metal overspray occurring during the coating process in the processing station.

A further improvement can be achieved in that a testing station for testing the metal plasma jet generated by the coating lance is arranged in the processing station. In said testing station, the spray pattern can be recorded by means of, for instance, a camera, measured and compared with a target spray pattern. Insofar as excessive deviations are found, a maintenance, particularly by means of cleaning the coating lance in the cleaning station can be arranged for through a control. The test results can also be used directly for controlling the coating device and in particular for generating the metal plasma jet.

According to another embodiment variant of the invention a further improvement is achieved in that a suction device is provided, which is designed to extract air from the coating device, the calibration station, the testing station, and/or the cleaning station. In particular in the coating device it is thus possible to discharge metal overspray during the coating process from the processing station together with the ambient air. Preferably, the system with the suction device is designed in such a manner that in the processing station with the coating device a certain negative pressure is set as compared to the ambience and in particular the loading station with the measuring device. With said negative pressure it is possible to counteract the passing over of overspray from the processing station to the loading station with the measuring device. This prevents an impairment of the measuring device by means of the undesired metal accumulations caused by overspray.

According to a further development of the invention, the measuring accuracy of the device is positively influenced in that at least one workpiece holder is provided, in which a workpiece can be deposited and clamped in a defined position, and that the workpiece holder is displaceable between the loading station and the processing station. The workpiece is thus continuously in a workpiece holder when being conveyed through the installation. In this way, the measured data allow particularly precise conclusions regarding the way of the coating, so that said data can be applied accordingly for controlling the coating device while the coating process.

According to one embodiment variant of the invention it is advantageous that the processing station and the loading station are separated from one another by a partition wall and that the partition wall comprises at least one lockable passage. The processing station and the loading station are hermetically separated from one another by the partition wall subdividing the housing into two areas. This particularly serves the purpose of preventing a passing over of overspray from the processing station to the loading station with the measuring device, and thus the undesired accumulations of metal particles at the sensitive measuring device. For the through-passage of the workpiece from the loading station to the processing station at least one passage is provided in the partition wall, which is lockable. The passage is thereby opened for only a short moment at a time to allow the through-passage of the workpiece from the one station to the other.

It is thereby particularly preferred according to a further development of the invention that the passage is closed by a locking element, which releases the passage in order to allow the through-passage of the workpiece. The locking element may be a door and in particular a displaceable or a pivotable closing plate. The locking element is thereby shifted to a release position by means of an actuator, a positioning cylinder or an adjustment mechanism when the workpiece reaches the passage. Once the workpiece has passed, the locking element is moved back into the locking position, with which the passage is tightly sealed.

According to another preferred embodiment a particularly efficient operation of the installation according to the invention in that the at least one workpiece holder is displaceable by means of a conveyor, which has an annular circulation path. The conveyor can be provided as any desired continuous conveyor, such as a chain conveyor, belt conveyor, or a similar conveyor with continuously circulating conveying element.

It is thereby particularly advantageous that the conveyor is shaped as a rotary table that is arranged horizontally displaceable. Preferably, the rotary table can thus accommodate two or even more workpieces.

According to a further development of the invention, it is expedient in case of a continuous conveyor to provide two through-passes in the partition wall with one locking element each. One of said through-passes serves for allowing the workpiece to pass from the loading station to the processing station, whereas the second through-pass serves the purpose of letting the workpiece pass from the processing station to the loading station.

Another preferred embodiment variant of the invention comprises a conveyor that is designed horizontally circumferentially, to which the workpiece holder is mounted, in particular pivotable around a horizontal pivoting axis. The workpiece holder in which the workpiece is deposited and clamped is thereby arranged horizontally in a basic orientation. When processing engine mounts comprising cylinder bores in a V or W configuration each of the workpieces can be pivoted around a horizontal pivoting axis and adjusted in such a manner that the respective cylinder bores to be processed are vertically aligned. With that, both an exact coating by means of the vertically displaceable coating lance as well as an exact measuring by means of the measuring device is made possible, whereby the measuring sensor of the measuring device is also mounted vertically displaceably.

The method according to the invention is characterized in that the generation of the coating and the measuring of the coating thickness are carried out integrated in an installation that is described above. With this method according to the invention, the advantages described above in coating a workpiece, particularly in coating bores in a workpiece can be realized.

The invention is preferably provided for coating bores in workpieces, in particular cylinder bores in engine mounts. Other applications are possible as well.

Figure 4:
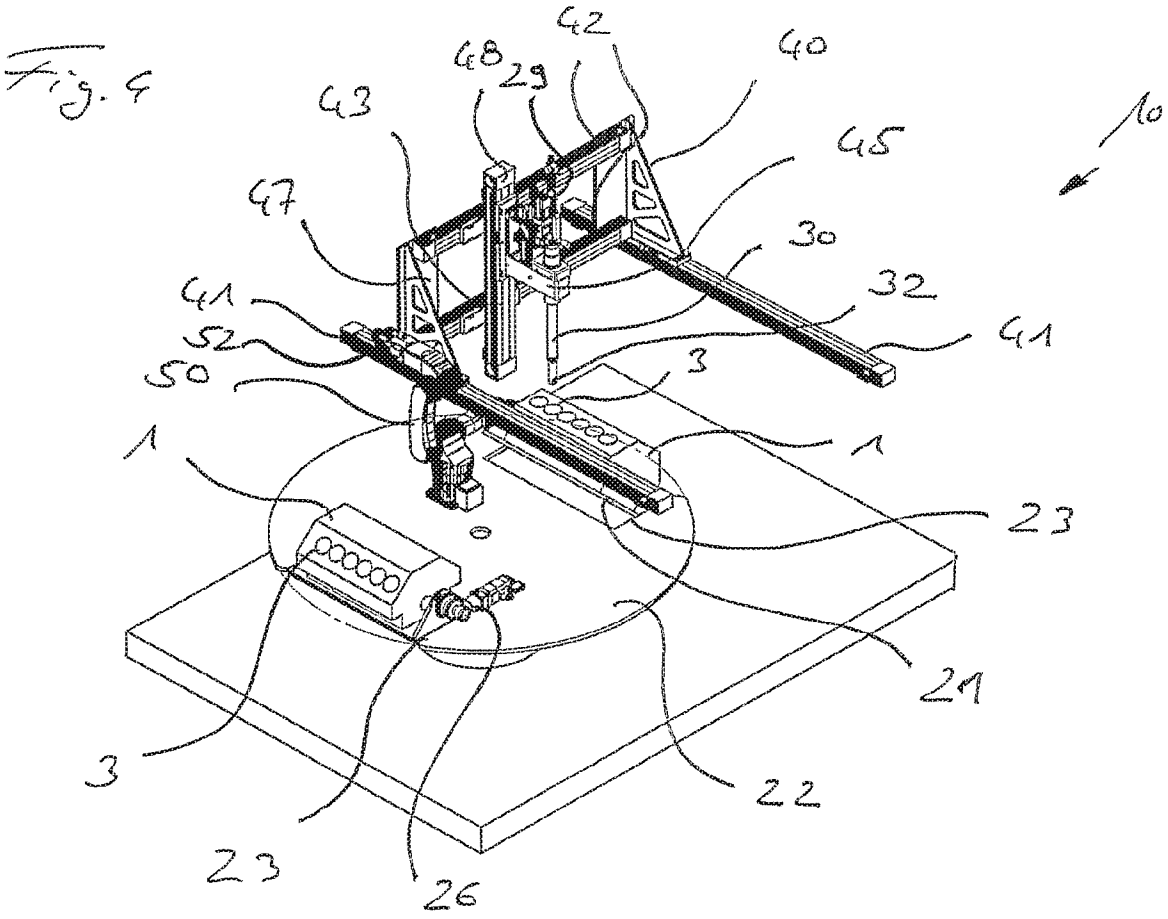

The invention is described hereunder with reference to a preferred embodiment example that is schematically illustrated in the attached drawings. The illustrations show the following:

FIG. 1: a schematic lateral view of an installation according to the invention;

FIG. 2: a side view of the installation of FIG. 1 folded by 90° in a strongly schematic form;

FIG. 3: a top view of the installation according to FIGS. 1 and 2;

FIG. 4: a schematic perspective view of the installation according to FIGS. 1 and 3, however without housing.

An installation 10 according to the invention for the metallic coating of bores 3 in a workpiece 1 is shown in FIGS. 1 to 4. The workpiece 1 in the illustrated embodiment example is an engine mount with 12 bores 3, which are arranged as cylinder bores in two rows of six in a V configuration in workpiece 1.

The installation 10 comprises a machine bed 11, on which a housing 13 is arranged. The box-shaped housing 13 encompasses a loading station 12 and a processing station 14 with a coating device 29.

On the machine bed 11 a basic frame 16 of a conveyor 20 is arranged for taking up a workpiece 1, said conveyor being designed as rotary table 22 in the visualized embodiment example. The horizontal rotary table 22 driven rotatably around a vertical rotation axis comprises two workpiece holders 23 opposite one another, each of which can take up a plate-shaped pallet module 21 with one workpiece 1 each. The pallet module 21 with the workpiece 1 can be pivoted opposite the horizontal extension through a pivoting unit 26, so that the bores 3 in the workpiece 1 can be arranged vertically for carrying out the metallic coating.

The workpiece 1 is accepted at the loading station 12 by a feeding unit that is not shown in the illustration. In the area of the loading station 12 the housing 13 comprises an opening with a door not shown in the illustration. In addition, in the area of the loading station 12 a measuring of the workpiece 1 can be carried out with a measuring device 52. Subsequently, the rotary table 22 is rotated by an angle of 180°, whereby the workpiece 1 is transported from the loading station 12 to the opposite processing station 14. The processing station 14 is separated from the loading station 12 by means of a partition wall 24. The partition wall 24 is shown only partially in the lower part of FIG. 2. The partition wall 24, however, extends throughout the inside of the housing 13, so that the processing station 14 is separated from the loading station 12. For the passing through of the workpieces 1 from the loading station 12 to the processing station 14 and back two passages 25 are provided. The passages 25 are each closed by means of a displaceable locking element 27, which is opened to allow the passing of the workpiece 1 and can subsequently be closed again.

The workpiece 1 is pivoted around a horizontal pivoting axis with the pivoting device 26 in the processing station 14, whereby one row of bores 3 is aligned vertically, as is apparent from FIGS. 1 to 4.

A coating device 29 is provided with a rod formed coating lance 30 for applying the metallic coating, which has at least one discharge opening 32 at its lower end for a metal plasma jet. The metal plasma jet is generated in a known way by means of a plasma generator comprising a cathode and a metallic anode. An electric arc is formed between the cathode and the anode by means of a correspondingly high electric voltage, by means of which the metallic anode is fused. The metallic anode is formed as feedable wire, so that there is always sufficient material to generate a metal plasma jet with the fused metallic particles. Instead of a wire, the supply of powder can also be provided as source of the metallic particles. A gas flow is generated by means of a gas jet installation, which is discharged through the discharge opening 32 at the lower end of the coating lance 30 almost horizontally at supersonic speed. The coating lance 30 with the discharge opening 32 is thereby introduced in the bore 3 to be coated in workpiece 1. The coating device 29 moreover comprises a tubular suction bell, which encases the coating lance 30, but which is not shown in FIGS. 1 to 4 for the sake of clarity.

For traversing the coating lance 30 a portal installation 40 with two parallel first traversing axes 41 is provided. On the first two traversing axes 41 a frame-like first displaceable slide 47 is arranged horizontally displaceable. The first displaceable slide 47 itself comprises two linear, horizontal second traversing axes 42, which extend parallel two one another and vertically to the first traversing axes 41.

Alongside the first two traversing axes 42 a beam-shaped second displaceable slide 48 is arranged horizontally displaceable. The second displaceable slide 48 itself has one single vertical third traversing axis 43. Alongside this third traversing axis 43, a sliding carriage 45 is positioned vertically displaceable. The coating lance 30 is rotatably held on the sliding carriage 45.

After positioning a workpiece 1 in the processing station 14, the coating lance 30 of the coating device 29 is fit in a first bore 3 of the workpiece 1 to be coated. The continuously operated coating lance 30 thereby generates a metal plasma jet which strikes one bore wall of the bore 3 at supersonic speed. By rotating the coating lance 30 and moving it axially in vertical direction, a regular pre-defined metallic coating with a thickness of, for instance, 10 μm to 300 μm is applied on the bore wall.

After retracting the coating lance 30 from the first coated bore 3, the metal plasma jet is directed towards an impact surface of a mounting unit in a suction bell not shown in the illustration directly after exiting the bore 3, whereby the suction bell is mounted on the sliding carriage 45 together with the coating lance 30. The mounting unit takes up the particles of the metal plasma jet and together with the coating lance 30 it is moved to the next bore 3 to be coated. Thereafter, the metallic coating is repeated at this second bore 3, whereby a corresponding coating of the further bore 3 in a row of the workpiece 1 follows. The workpiece 1 can subsequently be pivoted around a horizontal axis through the pivoting unit 26, so that the second row of the engine mount is arranged for processing in its vertical position. These six bores 3 in the engine mount-like workpiece 1 can be coated thereafter.

After completing the coating, the coating lance 30 with the portal unit 40 is retracted and the finished coated workpiece 1 can be transported back through the passage 25 on the right hand side, while simultaneously supplying a new workpiece 1 to be processed in the loading station 12. In that, the locking element 27 is opened at the passage 25. At the same time, a new workpiece 1 is transported from the loading station 12 to the processing station 14 through the opened passage 25 on the left hand side by means of the rotating movement of the rotary table 22.

The layer thickness and contour of the applied coating can be measured by a handling robot 50 comprising a measuring device 52. With the measuring device 52 the still uncoated bores 3 of a newly supplied workpiece 1 can be measured in advance, so that an even more accurate measuring of the completed coating by way of comparison of the measured data is made possible. The coated workpiece 1 can be removed from the workpiece holder 23 of the rotary table 22 in the loading station 12. Thereafter, a new workpiece 1 can be deposited in the workpiece holder 23 of the conveyor 20. Consequently, the loading and discharging as well as a measuring parallel to the processing of a workpiece 1 in the processing station 14 and thus without interfering with the machine's main time can take place in an installation 10 according to the invention. This makes an efficient use of the machine possible.

With the portal unit 40 the coating lance 30 can be moved to a testing station 54 at specific time intervals in order to verify the spray pattern of the metal plasma jet, or to a cleaning station 60.

The measuring device 52 comprises a laser with which the contour and the diameter of the bore 3 can be measured along the axial length of the bore 43 in that the measuring device 52 is vertically introduced into a bore 3 of the workpiece 1 through the handling robot 50. By comparing the measured data of bore 3 before and after coating, a control of the installation 10 helps determining the finished coating precisely with respect to the structure of the layer thicknesses and the surface contours. By comparing the measured values with the predefined target values it can be decided through controlling the installation 10, whether a correct coating has taken place, or whether the workpiece 1 has to be reworked. In addition, the control can adjust and modify set parameters of the coating device 29 based on the measured values, particularly the parameters for adjusting the metal plasma jet or the motion data of the coating lance 30 in order to counteract any aberrations in coating the following workpieces 1 in due course.

The invention claimed is:

1. An installation for the metallic coating of a workpiece, comprising:

a housing;

a loading station for supply and discharge of the workpiece and a processing station with a coating device provided within the housing, wherein:

the loading station comprises at least one workpiece holder, the at least one workpiece holder is displaceable by a rotary table that rotates to transfer the at least one workpiece holder and workpiece from the loading station to the processing station, the coating device comprises a displaceable coating lance, by which a metal plasma jet is generated to create a coating of metal particles, the coating device with the coating lance and a measuring device for measuring the coating thickness are jointly integrated in the installation and arranged in the housing, the processing station and the loading station are separated from one another by a partition wall comprising at least one closable passage that is closable by a displaceable locking element such that the workpiece passes through the closable passage when the displaceable locking element is in an open position and the partition wall is sealed at the at least one closable passage when the displaceable locking element is in a closed position, the measuring device is arranged in the loading station, and the measuring device is designed to measure the workpiece before and after the coating.

2. The installation according to claim 1, wherein:

the measuring device comprises a displaceable measuring sensor, which is displaceable between a calibration station and the workpiece holder in the loading station.

3. The installation according to claim 1, wherein:

a cleaning station for cleaning the coating lance is arranged in the processing station.

4. The installation according to claim 3, wherein:

a testing station is arranged in the processing station for testing the metal plasma jet generated by the coating lance.

5. The installation according to claim 1, wherein:

at least two workpiece holders are provided, and each workpiece holder is configured to hold a workpiece that is deposited and clamped in a defined position, and the workpiece holders are displaceable between the loading station and the processing station.

6. The installation according to claim 1, wherein:

in the partition wall two passages are provided with one locking element each.

7. The installation according to claim 1, wherein:

the conveyor is arranged circumferentially in horizontal direction, and that the workpiece holder is adjustably mounted to the conveyor such that the at least one workpiece holder pivots around a horizontal pivoting axis.

* * * * *